US007168999B2

(12) United States Patent
Yokoya et al.

(10) Patent No.: US 7,168,999 B2
(45) Date of Patent: Jan. 30, 2007

(54) EXHAUST GATE VALVE APPARATUS FOR A PERSONAL WATERCRAFT

(75) Inventors: Noboru Yokoya, Saitama (JP); Takeshi Kimishima, Saitama (JP); Yasunori Okazaki, Saitama (JP); Takeshi Koyabu, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/223,503

(22) Filed: Sep. 9, 2005

(65) Prior Publication Data

US 2006/0057909 A1 Mar. 16, 2006

(30) Foreign Application Priority Data

Sep. 14, 2004 (JP) ..... 2004-266481

(51) Int. Cl.
*B63H 21/32* (2006.01)

(52) U.S. Cl. ..... 440/89 R

(58) Field of Classification Search ..... 440/39, 440/89 R

See application file for complete search history.

(56) References Cited

U.S. PATENT DOCUMENTS 6,659,821 B2 * 12/2003 Nakajima ..... 440/89 R
2003/0013363 A1 * 1/2003 Yokoya et al. ..... 440/89
2004/0048527 A1 * 3/2004 Yokoya ..... 440/89 R

FOREIGN PATENT DOCUMENTS

JP 07-246996 9/1995

* cited by examiner

*Primary Examiner*—Stephen Avila
(74) *Attorney, Agent, or Firm*—Carrier, Blackman & Associates, P.C.; William D. Blackman; Joseph P. Carrier

(57) ABSTRACT

An exhaust gate valve apparatus of a water jet propulsion-driven watercraft is provided that is capable of positively closing an exhaust port with a valve body when an engine is stationary and widely opening the valve body when the engine runs. In the watercraft, an exhaust port of a tail pipe is arranged to face an opening in a top wall of a pump chamber. The exhaust gate valve apparatus includes a valve body, valve body support flange, pressure device, and a jet water expelling device. The valve body support flange attaches the valve body to the top wall. The pressure device urges the valve body to a closed position. The jet water expelling device diverts jet water from a water jet pump and opens the valve body using the jet water thus diverted, counteracting a pressing force of the pressure device and opening the valve body.

14 Claims, 10 Drawing Sheets

PRIOR ART

EXHAUST GATE VALVE APPARATUS FOR A PERSONAL WATERCRAFT

CROSS-REFERENCE TO RELATED APPLICATIONS

The present invention claims priority under 35 USC 119 based on Japanese patent application No. 2004-266481, filed on Sep. 14, 2004. The subject matter of this priority document is incorporated by reference herein.

BACKGROUND OF THE INVENTION

1. Field of the Invention

The present invention relates to an exhaust gate valve apparatus for a personal watercraft having a hollow pump chamber disposed in a rear portion of a hull. The exhaust gate valve resides at an exhaust port of an exhaust pipe arranged to face the pump chamber.

2. Background Art

One known example of a small watercraft is a personal watercraft of a type driven by water jet propulsion. In a water jet propulsion-driven watercraft, a water jet pump mounted at a rear portion of a hull draws in water from a hull bottom, and expels the drawn-in water rearwardly of the hull to propel the watercraft. In this type of watercraft, it is known to include a structure in which an exhaust port of an exhaust pipe, extended from an engine, is arranged to face a pump chamber, and in which the exhaust port can be opened or closed with a valve body. This known structure is disclosed, for example, in Japanese Laid-open Patent publication No. Hei 7-246996.

The art disclosed in Japanese Laid-open Patent publication No. Hei 7-246996 will be described below with reference to FIG. 10 of the present drawings, in which the basic conventional construction is illustrated.

In FIG. 10, a portion of water jet propulsion-driven watercraft 200 is shown which includes a hollow pump chamber 201 disposed at a rear portion of a watercraft hull. The pump chamber 201 includes a water jet pump, to which an engine is connected. An exhaust port 203 of an exhaust pipe 202, extended from the engine, is made to face the pump chamber 201. A valve body 205, made of a rubber plate, is disposed at a position near the exhaust port 203 via a fixing screw 204.

In the conventional structure, a pressure of exhaust gas (that is, an exhaust gas pressure) is not applied to valve body 205 when, for example, the engine is stationary. Accordingly, the valve body 205 is disposed at a closed position indicated by a solid line in FIG. 10. In this condition, the valve body 205 abuts and confronts an abutment surface 206, maintaining the exhaust port 203 in a closed position.

When the engine is run at high speeds, on the other hand, the exhaust gas pressure builds up, causing the built-up exhaust gas pressure to be applied to the valve body 205. As a result, the valve body 205 is elastically deformed, to take an open position indicated by broken lines in FIG. 10. Opening the exhaust port 203 allows the exhaust gas to be discharged therefrom, and continued pressure from exhaust gases tend keep the exhaust port 203 in an open position as long as the engine continues high-speed operation.

Because the conventional arrangement employs the elastic force of the rubber valve body 205 to close the exhaust port 203 when the engine is stationary, however, it is difficult to ensure a positive contact of the valve body 205 with the abutment surface 206. Unless the positive contact of the valve body 205 with the abutment surface 206 is achieved, a gap may be produced between the abutment surface 206 and the valve body 205. Accordingly, the valve body 205 may be unable to positively and consistently close the exhaust port 203.

As noted above, when the engine is operating at relatively high speed, exhaust gas pressure is applied to the valve body 205. When equilibrium is achieved between the exhaust gas pressure and the elastic force of the valve body 205, the valve body 205 is placed in a stationary state. It is difficult, however, for the exhaust gas pressure to counteract the elastic force of the valve body 205 and thereby widely open the valve body 205. A valve body 205 that is open only insufficiently could hamper proper discharge of the exhaust gas therethrough.

It is, therefore, an object of the present invention to provide an improved exhaust gate valve apparatus for a water jet propulsion-driven watercraft in which the exhaust gate valve apparatus is capable of positively closing an exhaust port with a valve body when an engine is idling and the watercraft is stationary, and in which the exhaust gate valve apparatus is also capable of widely opening the valve body when the engine operates at high speed.

SUMMARY OF THE INVENTION

To achieve the foregoing object, a first aspect of the present invention provides an exhaust gate valve apparatus for a water jet propulsion-driven watercraft including a hull, a hollow pump chamber disposed at a rear portion of the hull, and a water jet pump disposed in the pump chamber. The watercraft has an engine disposed in the hull and connected to the water jet pump, with the engine serving as a drive power source. The watercraft also includes an exhaust pipe extended from the engine, an exhaust port of the exhaust pipe being arranged to face the pump chamber. The exhaust gate valve apparatus according to the first aspect hereof includes a valve body for opening or closing the exhaust port, a pressure device for pressing the valve body to a closed state with respect to the exhaust port; and a jet water expelling device. The jet water expelling device is provided for diverting part of jet water from the water jet pump, and expelling the diverted jet water onto the valve body, so that a pressing force of the pressure device can be counteracted and the valve body can thereby be opened.

An arrangement is made to press the valve body against the exhaust port using the pressure device. The exhaust gate valve apparatus including the pressure device ensures that the valve body is positively pressed against the exhaust port, when the gate valve is closed.

The water jet propulsion-driven watercraft includes the water jet pump for allowing the hull to be propelled by the water jet. The jet water expelling device is operatively connected to the water jet pump, since the jet water expelling device receives part of the diverted jet water from the water jet pump and uses it for opening the valve body.

An expelling force of the jet water directed against the valve body is sufficiently larger than a pressing force of the pressure device. Accordingly, the use of the jet water allows the pressing force of the pressure device to be counteracted, so that the valve body can be sufficiently widely opened.

The first aspect of the present invention has the following advantages. Specifically, the pressure device is used to positively press the valve body against the exhaust port. This allows the valve body to be positively closed when the engine is stationary. Further, the jet water expelling device is used to open the valve body sufficiently widely. This allows exhaust gas to be preferably discharged without being affected by the valve body.

For a more complete understanding of the present invention, the reader is referred to the following detailed description section, which should be read in conjunction with the accompanying drawings. Throughout the following drawings and description, like numbers refer to like parts. The above-mentioned object, other objects, characteristics and advantages of the present invention will become apparent form the detailed description of the embodiment of the invention presented below in conjunction with the attached drawings.

BRIEF DESCRIPTION OF THE DRAWINGS

FIG. 8(*b*) is a side view of the exhaust gate valve apparatus of the personal watercraft of FIG. 1, illustrating an exemplary case in which the valve body of the exhaust gate valve apparatus is opened as a result of diverted water being directed through the left and right guide flow paths.

FIG. 9(*b*) is a side view of the exhaust gate valve apparatus of the personal watercraft of FIG. 1, illustrating an exemplary case in which the exhaust noise is shut off by noise insulation means of a water curtain formed within the pump chamber as seen from a direction perpendicular to that of FIG. 9(*a*)

DETAILED DESCRIPTION OF THE ILLUSTRATIVE EMBODIMENT

A personal watercraft including an exhaust gate valve apparatus according to a selected illustrative embodiment of the present invention will be described below, with reference to the accompanying drawings. For the purpose of this specification, "front," "rear," "left," and "right" denote corresponding directions considered from the vantage point of an operator seated on the watercraft and facing forward. In addition, "Fr" denotes front, "Rr" denotes rear, "L" denotes left, and "R" denotes right.

Figure 1:
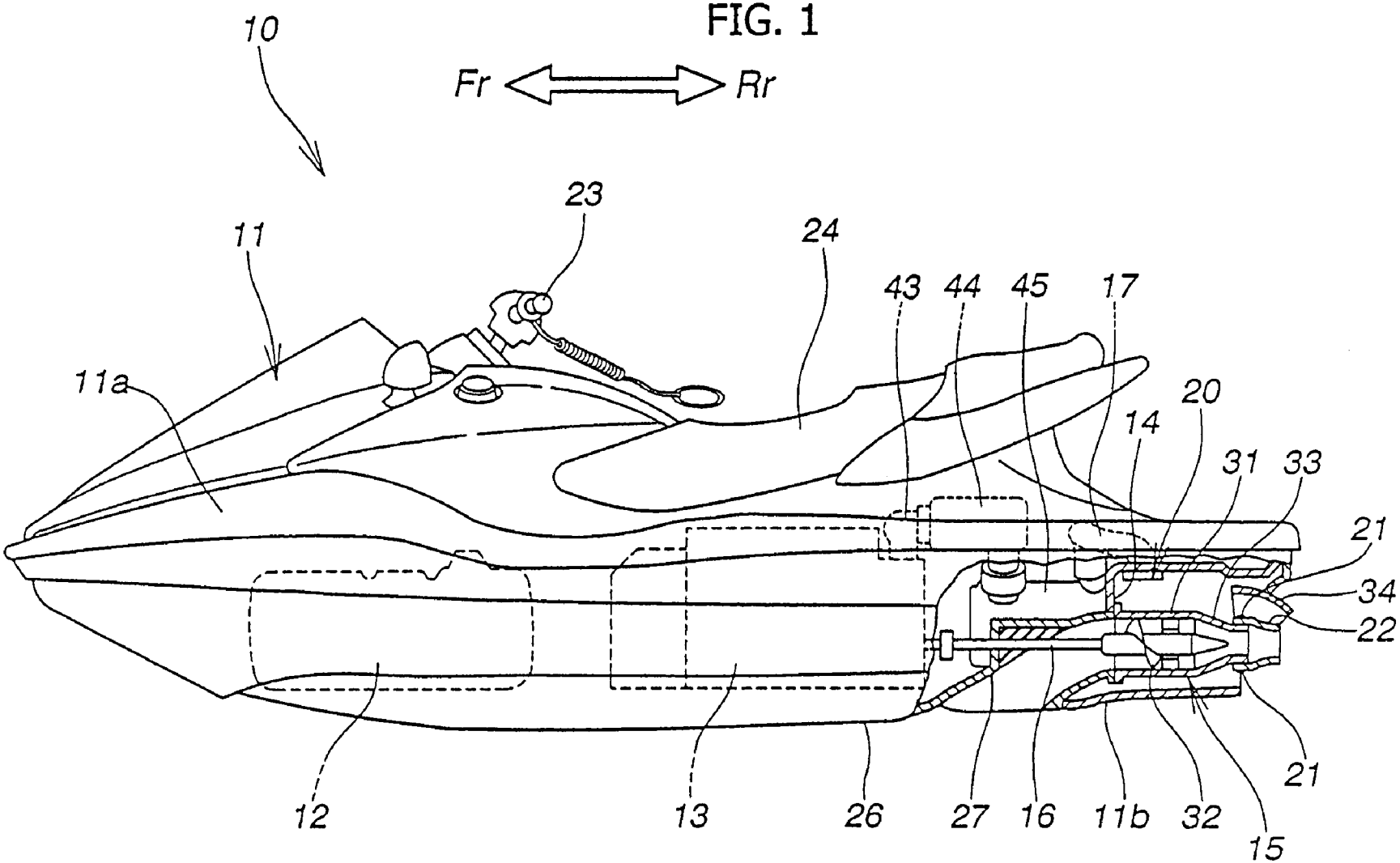
FIG. 1 is a side plan view of a personal watercraft showing an exhaust gate valve apparatus according to a selected illustrative embodiment of the present invention.

FIG. 1 is a side plan view of a personal watercraft 10, of a type which operates by water jet propulsion, and including an improved exhaust gate valve apparatus according to a selected illustrative embodiment of the present invention. The personal watercraft 10 includes a hull 11, which is configured to float in water, and which houses most other components of the watercraft. The personal watercraft 10 also includes a fuel tank 12, an engine 13, a pump chamber 14, a water jet pump 15, an exhaust pipe 17, and an exhaust gate valve apparatus 20. The fuel tank 12 is disposed at a front portion 11*a* of a hull 11. The engine 13 is disposed in back of the fuel tank 12, and functions as a drive power source. The pump chamber 14 is disposed at a stern (a rear portion of the hull) 11*b* located in back of the engine 13. The water jet pump 15 is disposed inside the pump chamber 14. The engine 13 is connected to the water jet pump 15 via a drive shaft 16. An exhaust port 18 (see FIG. 4) of the exhaust pipe 17, extended from the engine 13, is arranged to face the pump chamber 14. The exhaust gate valve apparatus 20 opens or closes the exhaust port 18.

The water jet propulsion-driven watercraft 10 further includes a steering nozzle 22, a steering handlebar 23, and a seat 24. The steering nozzle 22 is disposed in back of the water jet pump 15 and is pivotally mounted, via upper and lower pins 21, 21, so as to be swingably movable to the right and left. The steering handlebar 23 for swingably operating the steering nozzle 22 is disposed above the fuel tank 12, as shown. The seat 24 is disposed in back of the steering handlebar 23.

The water jet pump 15 is constructed as follows. Specifically, the water jet pump 15 includes a hollow, tubular housing 31 that extends rearwardly from a rear end of an intake port 27 disposed in a hull bottom 26. An impeller 32 is rotatably mounted inside the housing 31 and connected to the drive shaft 16 of the engine 13.

During operation of the water jet pump 15, the engine 13 is driven to rotate the impeller 32 via the drive shaft 16. This results in water being drawn in through the intake port 27 in the hull bottom 26, and this water is then expelled rearwardly through the steering nozzle 22, via a rear portion 33 of the flow housing 31. Expelling water rearwardly from the steering nozzle 22 causes the hull 11 to plane in a forward advancing manner.

Further, a reverse bucket 34 is disposed at a point near the steering nozzle 22. The reverse bucket 34 is selectively swung rearwardly of the steering nozzle 22, about a support pin 36 (see FIG. 2). The hull 11 is moved backwardly by guiding water expelled from the steering nozzle 22 forwardly, using the reverse bucket 34.

The exhaust gate valve apparatus 20 of the water jet propulsion-driven watercraft will be described in detail below.

Figure 2:
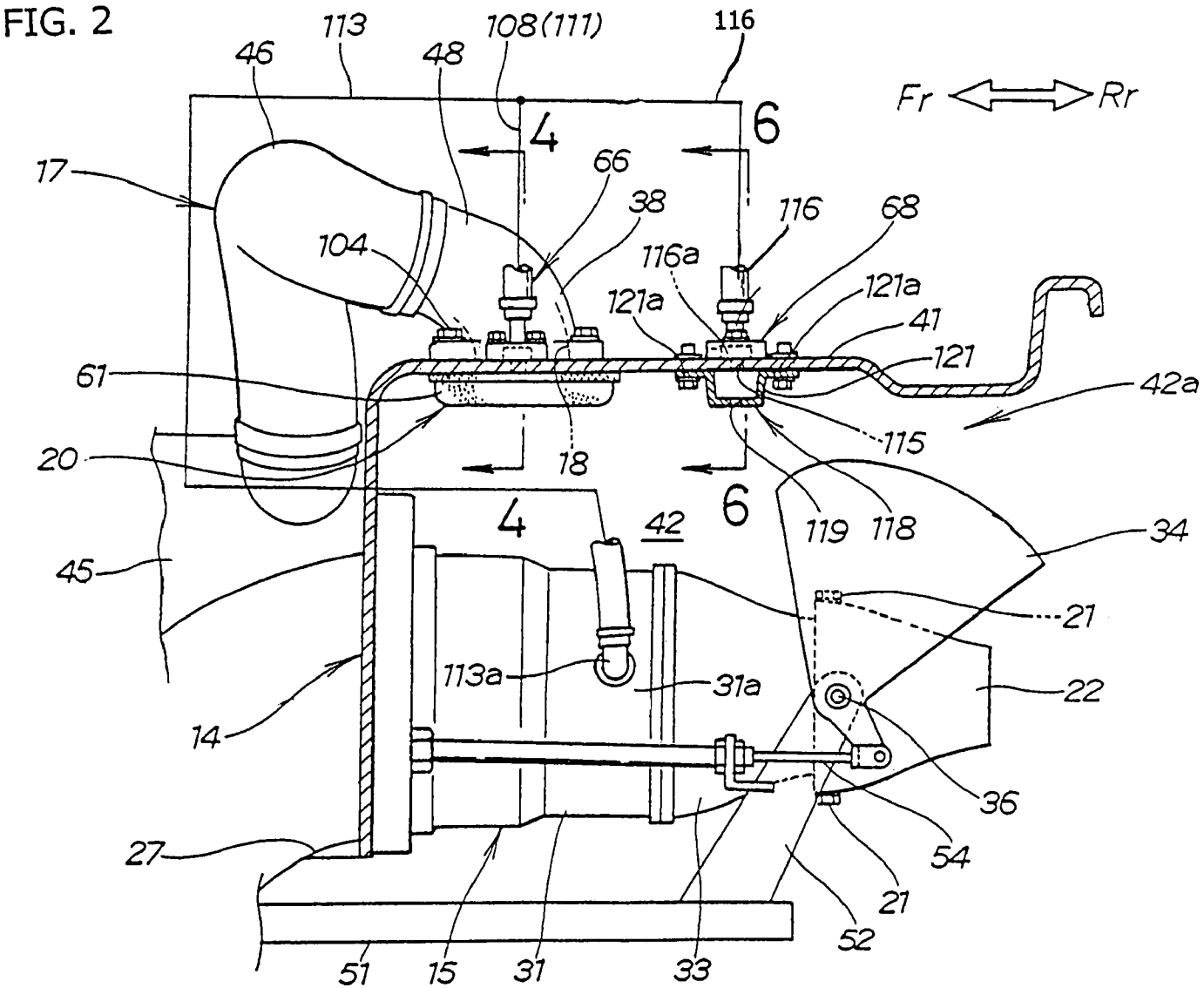
FIG. 2 is a detail side plan view of the exhaust gate valve apparatus of the personal watercraft of FIG. 1, partially in cross-section and showing the exhaust gate valve mounted to a top wall portion of the pump chamber.

FIG. 2 is a side plan view showing the exhaust gate valve apparatus of the personal watercraft according to the illustrative embodiment of the present invention. The exhaust pipe 17 is operatively connected to an exhaust manifold (not shown) of the engine 13. A discharge side end portion 38 passes through a top wall 41 of the pump chamber 14. The exhaust port 18 of the discharge side end portion 38 is configured to face a space 42 in the pump chamber 14.

The exhaust system includes an exhaust pipe 43, an exhaust body 44 (see FIG. 1), a muffler 45, a connection pipe 46, and a tail pipe 48. The exhaust pipe 43 is connected to the exhaust manifold. The muffler 45 is connected to an outlet side of the exhaust body 44. The connection pipe 46 is connected to an outlet of the muffler 45. The tail pipe 48 is connected to an exhaust port of the connection pipe 46. A discharge side end portion of the tail pipe 48 (that is, the discharge side end portion 38 of the exhaust pipe 17) is fitted to the top wall 41 of the pump chamber 14.

The pump chamber 14 contains the water jet pump 15, disposed at a center of the pump chamber 14. A hull bottom plate 51 is disposed below the water jet pump 15 and defines the bottom of the pump chamber 14. The hull bottom plate 51 closes an opening which would otherwise be present at the bottom of the pump chamber 14, thereby forming the space 42. The space 42 is a tunnel-shaped space having an open rear end 42*a*.

The water jet pump 15 includes a rear nozzle portion 33, disposed at a rear end portion of a flow housing 31. The steering nozzle 22 is disposed at a rear end portion of the rear nozzle portion 33. The steering nozzle 22 is mounted via the upper and lower pins 21, 21, so as to be swingably movable to the right and left in response to movement of the steering handlebar 23.

The hull bottom plate 51 includes a bracket 52 disposed at a rear end portion thereof. The reverse bucket 34 is swingably mounted to the bracket 52 via the support pin 36. The reverse bucket 34 is disposed at the open rear end 42*a* of the pump chamber 14. The reverse bucket 34 is pivotally swingable about the support pin 36 between a first position and a second position. The first position is an advancing position, in which the reverse bucket 34 is located upward of the steering nozzle 22. The second position is a reversing position, in which the reverse bucket is located in back of the steering nozzle 22.

A steering cable (not shown) is operated using the steering handlebar 23 (see FIG. 1) to swing the steering nozzle 22 to the right or left, thereby controlling the steering direction of the hull 11. A reverse cable 54 is operated using an operation lever (not shown) of the steering handlebar 23. The reverse bucket 34 is thereby selectively disposed at the reversing position in back of the steering nozzle 22, thus reversing the movement direction of the hull 11, as needed.

The exhaust gate valve apparatus 20 of the water jet propulsion-driven watercraft is constructed as follows. Specifically, the top wall 41 of the pump chamber 14 is provided with an opening portion 56 (see FIG. 3) formed therethrough. The exhaust port 18 of the tail pipe 48 is made to face the opening portion 56. The exhaust gate valve apparatus 20 further includes a valve body 61, valve body support flange 62 (see FIG. 3), a pressure device 64 (see FIG. 3), a jet water expelling device 66, and a noise insulator 68. The valve body 61 is operable to open or close the exhaust port 18. The valve body support flange 62 attaches the valve body 61 to the top wall 41. The pressure device 64 presses the valve body 61 to bring the valve body 61 into a position of closing the exhaust port 18. The jet water expelling device 66 diverts part of the jet water from the water jet pump 15 and, using the diverted jet water, opens the valve body 61 so that a pressing force of the pressure device 64 is counteracted, and the valve body 61 is thereby opened. The noise insulator 68 forms a water curtain 67 (see FIG. 9(*a*)) by using the diverted jet water.

Figure 3:
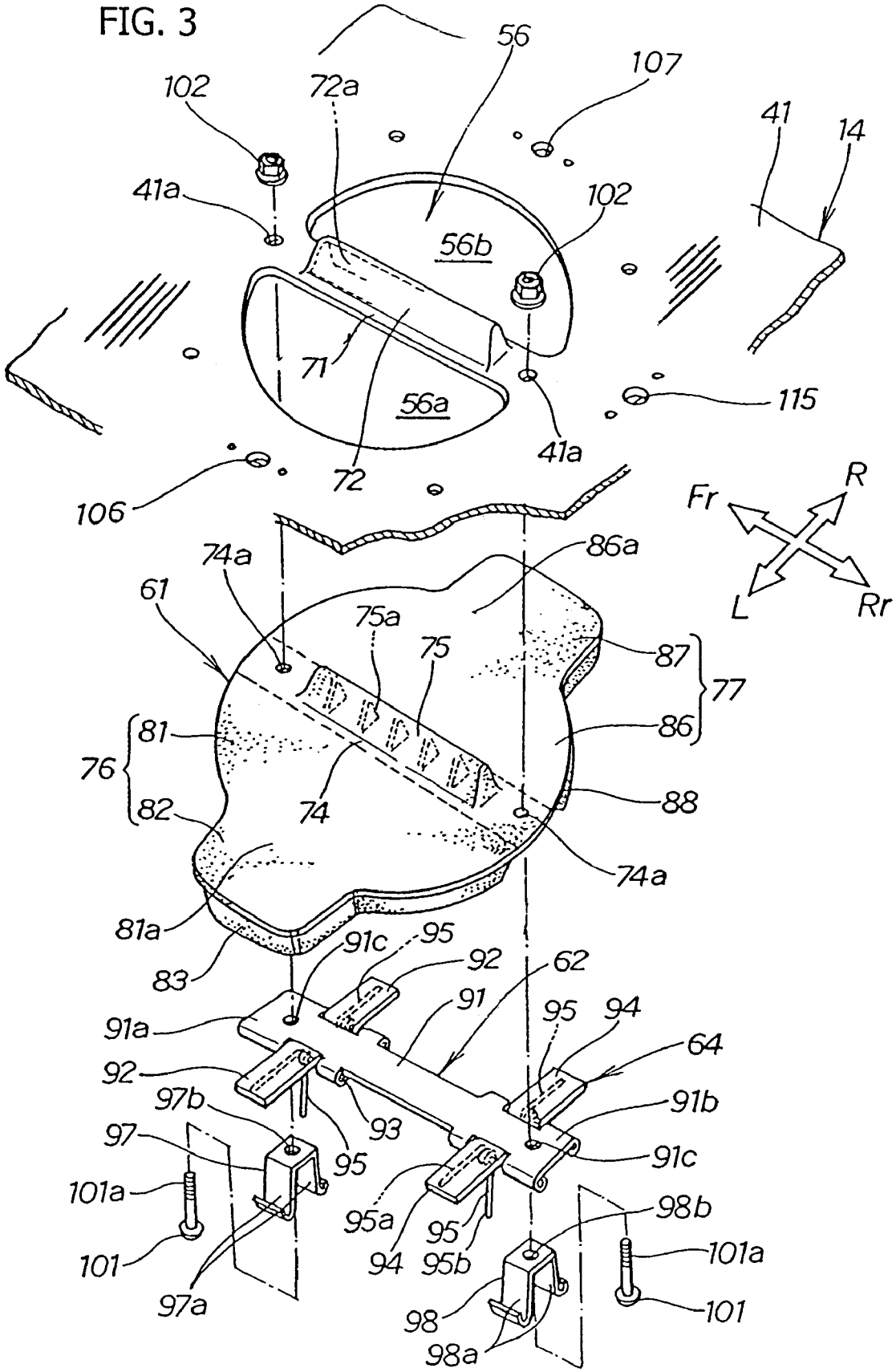
FIG. 3 is an exploded perspective view of the exhaust gate valve apparatus of the personal watercraft of FIG. 1, showing the valve body including a central protruding ridge portion received within a recessed portion of a support beam of the top wall portion.

FIG. 3 is an exploded perspective view showing a principal part of the exhaust gate valve apparatus of the water jet propulsion-driven watercraft according to the illustrative embodiment of the present invention. The top wall 41 of the pump chamber 14 is provided with the opening portion 56 formed therein. The valve body 61 is attached to the top wall 41 via the valve body support flange 62, to cover the opening portion 56. The opening portion 56 in the top wall 41 is an exhaust hole formed substantially in a bifurcated circular shape. The opening portion 56 includes a left-hand side opening 56*a* and a right-hand side opening 56*b*, the two being partitioned by a support beam 71 extending therebetween, in a fore-aft direction, at a center of the opening portion 56.

The support beam 71 includes a guide portion 72 having a V-shaped cross section or a substantially V-shaped cross section. The guide portion 72 is disposed on a surface facing the exhaust port 18 (see FIGS. 2 and 4) of the tail pipe 48. By forming the guide portion 72 to have the V-shaped cross section or the substantially V-shaped cross section, the guide portion 72 protrudes in a tapered manner toward the exhaust port 18 of the tail pipe 48 (or upwardly) (see FIG. 4). By forming the support beam 71 so as to include the guide portion 72, a lower surface side of the support beam 71 (the side of a surface facing the pump chamber 14) includes a recessed portion 72*a*.

The valve body 61 is an elastic member made of rubber or a heat-tolerant elastomer, and is formed generally in a circular shape. The valve body 61 includes a mounting portion 74 disposed substantially at a center thereof. The mounting portion 74 includes a protruding ridge portion 75, which, when assembled, abuts the support beam 71. Reinforcement ribs 75*a* are formed at predetermined intervals on the bottom of the valve body 61, spaced at regular intervals along a recessed portion on the underside of the protruding ridge portion 75. The reinforcement ribs 75*a* allow the protruding ridge portion 75 to engage with the recessed portion 72*a* of the support beam 71.

The valve body 61 further includes left and right flaps 76, 77 disposed on either side (left-hand and right-hand sides) of the mounting portion 74. The left flap 76 includes a left arcuate portion 81 and a left protruding tab 82. The left arcuate portion 81 is formed into substantially a semi-arcuate shape. The left protruding tab 82 of substantially a rectangular shape is formed integrally with the left arcuate portion 81 at a vertex portion 81*a* of the left arcuate portion 81. The left arcuate portion 81 and the left protruding tab 82 include a reinforcement rib 83 disposed along a peripheral edge on a lower surface thereof.

Similarly, the right flap 77 includes a right arcuate portion 86 and a right protruding tab 87. The right arcuate portion 86 is formed into substantially a semi-arcuate shape. The right protruding tab 87 of substantially a rectangular shape is formed integrally with the right arcuate portion 86 at a vertex portion 86*a* of the right arcuate portion 86. The right arcuate portion 86 and the right protruding tab 87 also include a reinforcement rib 88 disposed along a peripheral edge on a lower surface thereof.

The valve body support flange 62 includes a mounting plate 91 having substantially a rectangular shape. Each of front and rear end portions 91*a*, 91*b* of the mounting plate 91 are provided with mounting holes 91*c*, 91*c*.

The pressure device 64 includes right and left front swinging tabs 92, 92 and right and left rear swinging tabs 94, 94. The front swinging tabs 92, 92 are swingably mounted at the front end portion 91*a* of the mounting plate 91 via pins 93, 93. The rear swinging tabs 94, 94 are swingably mounted at the rear end portion 91*b* of the mounting plate 91 via pins 93, 93.

Mounting a torsion spring 95 to each of the pins 93 achieves the following functions. Specifically, one end 95*a* of each of the torsion springs 95 is brought into contact with the right and left front swinging tabs 92, 92 and the right and left rear swinging tabs 94, 94. The other end 95*b* of each of the front torsion springs 95, 95 of all torsion springs 95 is brought into contact with support tabs 97*a*, 97*a* of a front support portion 97.

Similarly, the other end 95*b* of each of the rear torsion springs 95, 95, respectively, is brought into contact with support tabs 98*a*, 98*a* of a rear support portion 98.

The valve body 61, constructed as described in the foregoing, is mounted to the top wall 41 of the pump chamber 14 as follows. Specifically, the protruding ridge portion 75 of the valve body 61 is received within and engaged with the recessed portion 72*a* in the support beam 71. The mounting portion 74 of the valve body 61 is thereby positioned correctly relative to the support beam 71. The mounting plate 91 of the valve body support flange 62 is then pressed against the mounting portion 74.

In this condition, bolts 101, 101 are inserted through mounting holes 41*a*, 41*a* in the top wall 41, mounting holes 74*a*, 74*a* in the mounting portion 74, mounting holes 91*c*, 91*c* in the mounting plate 91, and mounting holes 97*b*, 98*b* in the front and rear support portions 97, 98. Nuts 102, 102 are then screw-threadably engaged with threaded portions 101*a*, 101*a* protruded from the mounting holes 41*a*, 41*a* in the top wall 41. The mounting portion 74 of the valve body 61 is thereby clamped between the top wall 41 and the mounting plate 91. The mounting portion 74 of the valve body 61 is mounted to a back surface of the top wall 41.

The left front swinging tab 92 and the left rear swinging tab 94 are pressed against a lower surface of the left flap 76 by a spring force of the left front torsion spring 95 and the left rear torsion spring 95.

Similarly, the right front swinging tab 92 and the right rear swinging tab 94 are pressed against a lower surface of the right flap 77 by a spring force of the right front torsion spring 95 and the right rear torsion spring 95.

Figure 4:
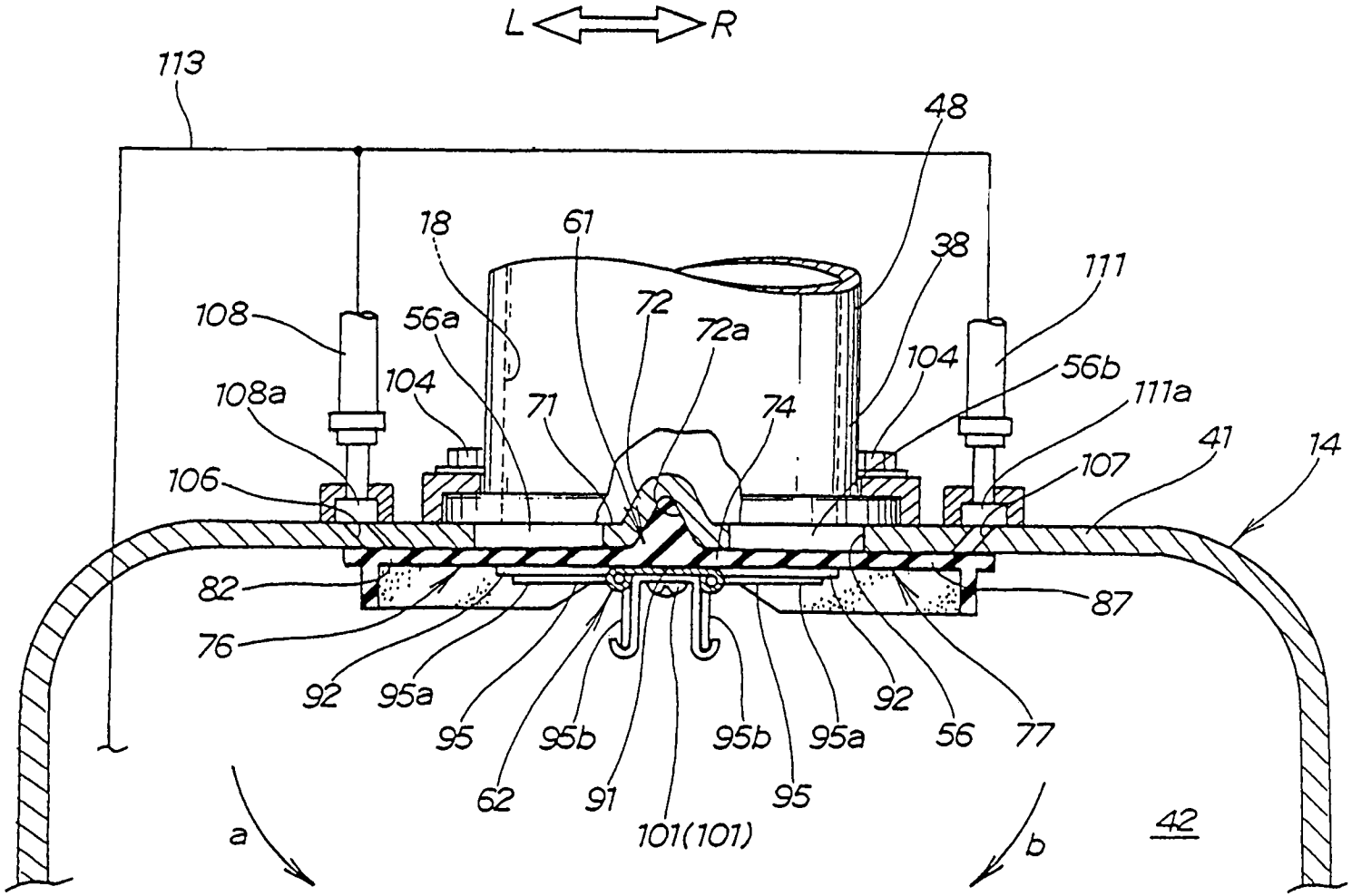
FIG. 4 is a cross-sectional view of the exhaust gate valve apparatus of the personal watercraft of FIG. 1, taken along line 4—4 of FIG. 2 and showing the valve body sandwiched between the valve body support flange and the support beam of the top wall portion.
Figure 5:
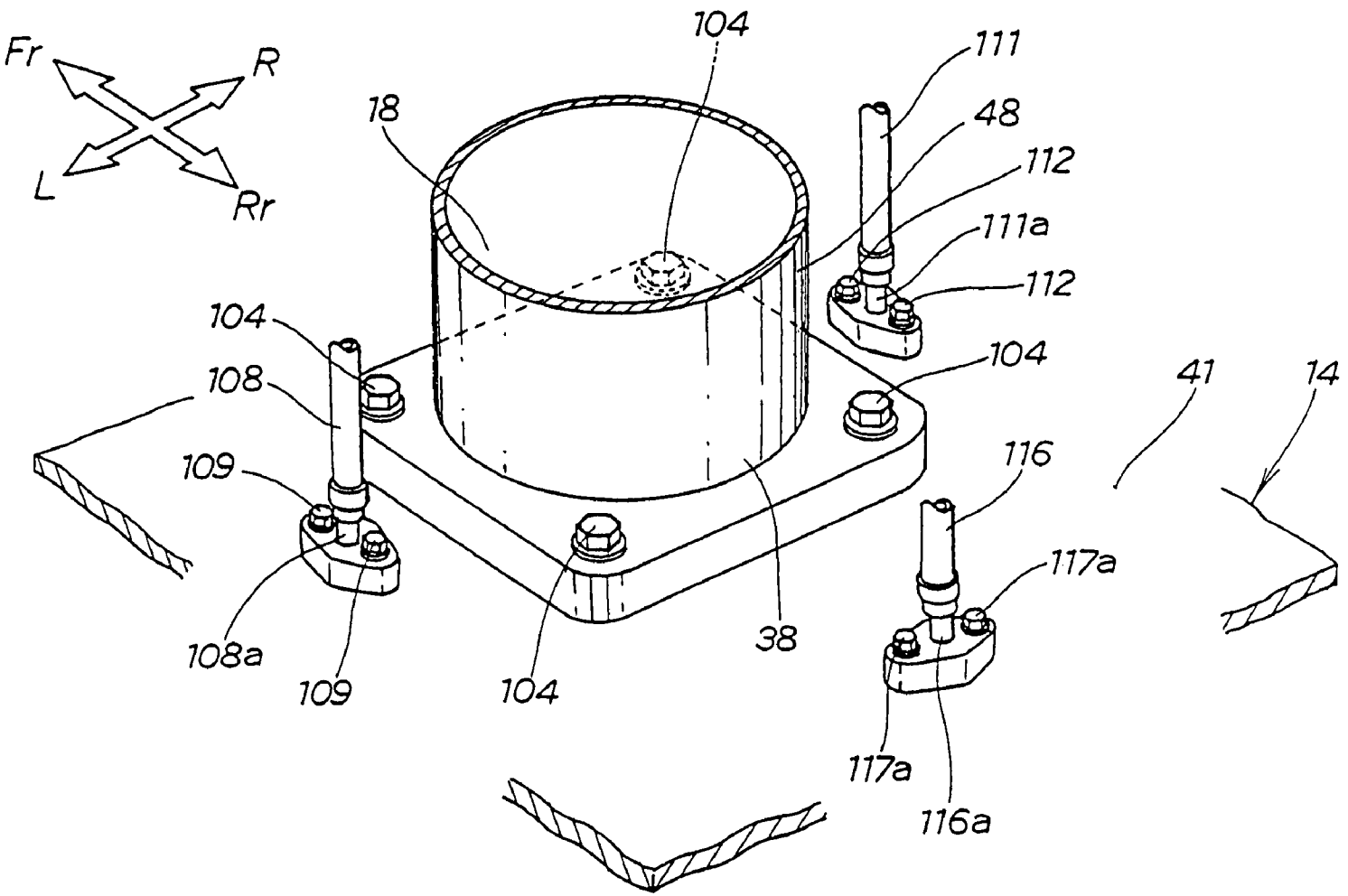
FIG. 5 is an upper perspective view of the exhaust gate valve apparatus of the personal watercraft of FIG. 1, showing the arrangement of the left and right guide flow paths and the rear guide flow path relative to the exhaust port.

FIG. 4 is a cross-sectional view of the exhaust gate valve taken along line 4—4 of FIG. 2. FIG. 5 is a perspective view of the exhaust gate valve showing a principal part of the exhaust gate valve apparatus of the water jet propulsion-driven watercraft 10, according to the illustrative embodiment of the present invention. The discharge side end portion 38 of the tail pipe 48 is mounted on a front surface of the top wall 41 of the pump chamber 14 using four bolts 104. The exhaust port 18 of the tail pipe 48 is thus made to face the opening portion 56 in the top wall 41. In this condition, the guide portion 72 of the top wall 41 is disposed so as to protrude upwardly, as shown, toward the exhaust port 18 of the tail pipe 48.

The mounting plate 91 of the valve body support flange 62 is, on the other hand, mounted to the back surface of the top wall 41 using the bolts 101, 101 and the nuts 102, 102 (see FIG. 3 for the nuts 102, 102). The mounting portion 74 of the valve body 61 is thereby mounted to the back surface of the top wall 41 with the valve body support flange 62. The left front swinging tab 92 and the left rear swinging tab 94 (see FIG. 3 for the left rear swinging tab 94) are pressed against the lower surface of the left flap 76 by the spring force of the left front torsion spring 95 and the left rear torsion spring 95 (see FIG. 3 for the left rear torsion spring 95).

Similarly, the right front swinging tab 92 and the right rear swinging tab 94 (see FIG. 3 for the right rear swinging tab 94) are pressed against the lower surface of the right flap 77 by the spring force of the right front torsion spring 95 and the right rear torsion spring 95 (see FIG. 3 for the right rear torsion spring 95).

The left and right flaps 76, 77 are pressed positively against the back surface of the top wall 41 by the spring force of the corresponding one of the torsion springs 95. Accordingly, the left-hand side opening 56*a* of the opening portion 56 is positively closed by the left flap 76 and the right-hand side opening 56*b* of the opening portion 56 is positively closed by the right flap 77. The left and right flaps 76, 77 can therefore positively close the opening portion 56 in the top wall 41, allowing the valve body 61 to close positively the exhaust port 18.

The top wall 41 includes a left expelling hole 106 formed to the left of the tail pipe 48. The left expelling hole 106 faces the left protruding tab 82 of the valve body 61. The top wall 41 also includes a right expelling hole 107 formed to the right of the tail pipe 48. The right expelling hole 107 faces the right protruding tab 87 of the valve body 61. The left expelling hole 106 is a through hole inclined downwardly toward a center of the hull 11. The right expelling hole 107 is a through hole inclined downwardly toward a center of the hull 11.

An end portion 108*a* of a left guide flow path 108 is oriented toward the left expelling hole 106 and the end portion 108*a* is attached to the top wall 41 with bolts 109, 109 and nuts (not shown) (see FIG. 5).

Similarly, an end portion 111*a* of a right guide flow path 111 is oriented toward the right expelling hole 107 and the end portion 111*a* is attached to the top wall 41 with bolts 112, 112 and nuts (not shown) (see FIG. 5).

The left guide flow path 108 and the right guide flow path 111 are joined together with a diverter flow path 113. An end portion 113*a* of the diverter flow path 113 is attached to a rear portion of the housing 31 of the water jet pump 15 (see FIG. 2). More specifically, an outer wall 31*a* in the rear portion of the water jet pump housing 31 includes a diverter hole (not shown) that penetrates the outer wall 31*a*. The diverter hole is oriented toward a space inside the housing 31 and in back of the impeller 32 (see FIG. 1). The end portion 113*a* of the diverter flow path 113 is brought in communication with the diverter hole.

In the water jet pump 15, jet water is produced in back of the impeller 32 when the impeller 32 (see FIG. 1) rotates. Part of the jet water produced is diverted to the diverter flow path 113 through a diverter port (not shown). The diverted jet water sent to the diverter flow path 113 is guided to the left guide flow path 108 and the right guide flow path 111. The jet water guided to the left guide flow path 108 and the right guide flow path 111 is further guided to the left expelling hole 106 and the right expelling hole 107, respectively.

The jet water guided to the left expelling hole 106 is expelled from the left expelling hole 106 and aimed at the left protruding tab 82 of the left flap 76. When the jet water hits against the left protruding tab 82, an expelling force of the jet water is applied to the left protruding tab 82. The expelling force of the jet water is sufficiently larger than the pressing force of the left torsion springs 95, 95. Accordingly, the jet water counteracts the pressing force of the left torsion springs 95, 95, causing the left flap 76 to open widely in the direction of an arrow a shown in FIG. 4.

Similarly, the jet water guided to the right expelling hole 107 is expelled from the right expelling hole 107 and aimed at the right protruding tab 87 of the right flap 77. When the jet water hits against the right protruding tab 87, an expelling force of the jet water is applied to the right protruding tab 87. The expelling force of the jet water is sufficiently larger than the pressing force of the right torsion springs 95, 95. Accordingly, the jet water counteracts the pressing force of the right torsion springs 95, 95, causing the right flap 77 to open widely in the direction of an arrow b shown in FIG. 4.

Widely opening the right and left flaps 76, 77 with the jet water as described above allows the valve body 61 to be opened sufficiently widely.

Referring back to FIG. 2, the noise insulator 68 is constructed as follows. Specifically, there is provided an introduction hole 115 that passes through the top wall 41 from a front surface to a rear surface of the top wall 41 at a position in back of the tail pipe 48. An end portion 116*a* of a rear guide flow path 116 is oriented toward the introduction hole 115. The end portion 116*a* is attached to the top wall 41 (see FIG. 5) using bolts 117*a*, 117*a* and nuts 117*b*, 117*b* (see FIG. 6). A dispersion flow path 118 is disposed on a back surface of the top wall 41. The dispersion flow path 118 is arranged to communicate with the introduction hole 115. The dispersion flow path 118 includes a plurality of expelling holes 119 disposed on a bottom portion thereof so as to face downwardly.

The rear guide flow path 116 is branched out from the diverter flow path 113. The dispersion flow path 118 is disposed in the pump chamber 14, in back of the exhaust port 18 of the tail pipe 48.

Figure 6:
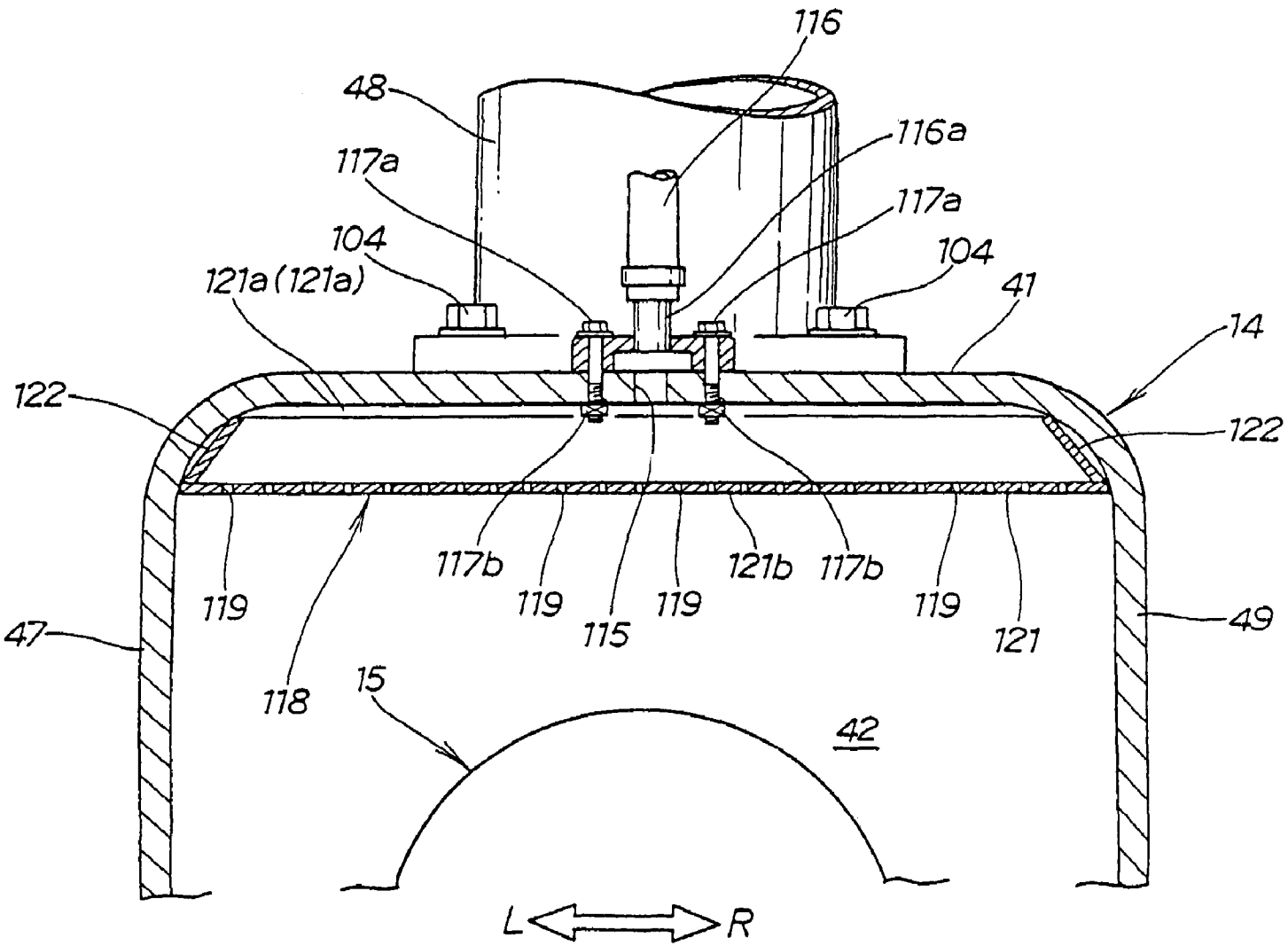
FIG. 6 is a cross-sectional view of the exhaust gate valve apparatus of the personal watercraft of FIG. 1, taken along line 6—6 of FIG. 2, showing the dispersion flow path extending completely across the open interior space of the pump chamber in the left-to-right direction.

FIG. 6 is a cross-sectional view taken along line 6—6 of FIG. 2. The dispersion flow path 118 is formed as detailed in the following. Specifically, a trough member 121 (see also FIG. 2) having substantially a U cross section is disposed in the pump chamber 14. The trough member 121 extends in a crosswise direction of the hull 11 up to left and right walls 47, 49 of the pump chamber 14. Right and left ends of the trough member 121 are plugged with plates 122, 122. Mounting tabs 121*a*, 121*a* (see also FIG. 2) of the trough member 121 are attached to the back surface of the top wall 41 using bolts and nuts. The dispersion flow path 118 is thus formed between the trough member 121 and the top wall 41.

The dispersion flow path 118 is disposed above the rear nozzle portion 33 of the water jet pump 15 as shown in FIG. 2. The dispersion flow path 118 includes the plurality of expelling holes 119 disposed at predetermined intervals in a bottom portion 121*b* of the trough member 121.

Part of the jet water is diverted from the water jet pump 15 shown in FIG. 2 via the diverter flow path 113. Part of the jet water that has been diverted is introduced to the rear guide flow path 116 from the diverter flow path 113. The jet water introduced to the rear guide flow path 116 is guided to the dispersion flow path 118 through the introduction hole 115. The jet water guided into the dispersion flow path 118 is expelled toward the space 42 of the pump chamber 14 from the plurality of expelling holes 119. A water curtain 67 (see FIG. 9(*a*)) is formed as a result of the jet water flowing outwardly through the plurality of expelling holes 119.

Figure 7:
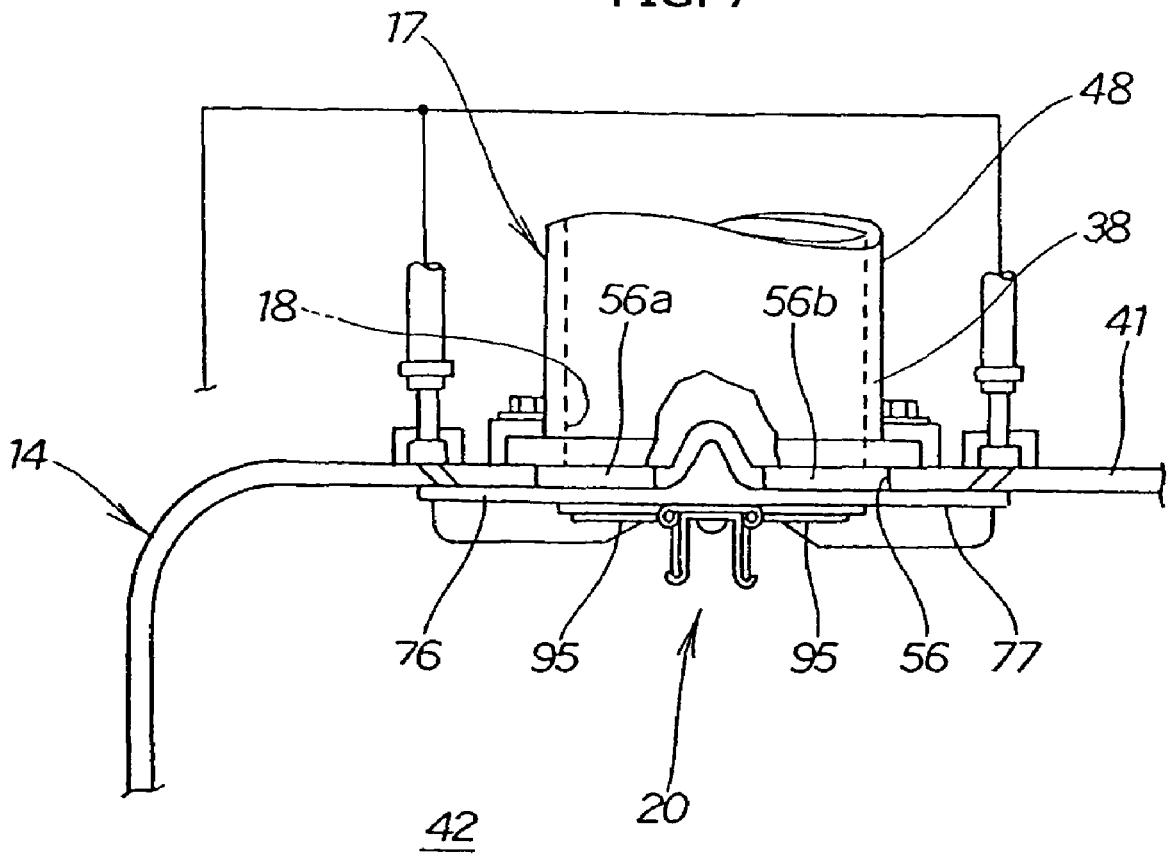
FIG. 7 is a side view of the exhaust gate valve apparatus of the personal watercraft of FIG. 1, illustrating an exemplary case in which the valve body of the exhaust gate valve apparatus is closed.

In operation, the exhaust gate valve apparatus 20 of the water jet propulsion-driven watercraft according to the illustrative embodiment of the present invention will be described in the following. An exemplary case, in which the exhaust port 18 is closed in the exhaust gate valve apparatus 20 of the water jet propulsion-driven watercraft according to the illustrative embodiment of the present invention, will be first described with reference mainly to FIG. 7. FIG. 7 is a view which illustrates the exemplary case in which the valve body of the exhaust gate valve apparatus of the water jet propulsion-driven watercraft according to the illustrative embodiment of the present invention is closed. When the engine 13 (see FIG. 1) of the water jet propulsion-driven watercraft 10 is idling with the watercraft stationary, the left flap 76 is positively pressed up against the back surface of the top wall 41 by the spring force of the left front torsion spring 95 and the left rear torsion spring 95 (see FIG. 3 for the left rear torsion spring 95).

Similarly, the right flap 77 is positively pressed up against the back surface of the top wall 41 by the spring force of the right front torsion spring 95 and the right rear torsion spring 95 (see FIG. 3 for the right rear torsion spring 95). Accordingly, the left-hand side opening 56*a* of the opening portion 56 is positively closed with the left flap 76. Similarly, the right-hand side opening 56*b* of the opening portion 56 is positively closed with the right flap 77.

The opening portion 56 in the top wall 41 is thus positively closed with the left and right flaps 76, 77. The exhaust port 18 is therefore positively closed with the valve body 61. Accordingly, entry of water from the side of the pump chamber 14 to the exhaust port 18 is properly prevented when the engine 13 remains stationary.

It is to be noted herein that, for ordinary water jet propulsion-driven watercrafts, it is necessary to form the connection pipe 46 of the exhaust pipe 17 (see FIG. 2) into an inverted U-shape in consideration of possible entry of water in the exhaust pipe 17 through the exhaust port 18 from the side of the pump chamber 14. The connection pipe 46 is formed into the inverted. U-shape so that water that has entered the exhaust pipe 17 can be blocked off and prevented from flowing to the side of the engine 13 (see FIG. 1). Forming the connection pipe 46 into the inverted U-shape, however, results in the connection pipe 46 becoming longer. This makes it necessary to provide a large space in which to dispose the connection pipe 46.

In the water jet propulsion-driven watercraft 10 according to the illustrative embodiment of the present invention, on the other hand, entry of water in the exhaust port 18 from the side of the pump chamber 14 can be positively prevented when the engine 13 is idling or running at low speed, by providing the exhaust gate valve apparatus 20 hereof, for the water jet propulsion-driven watercraft 10. This eliminates the necessity of forming the connection pipe 46 of the exhaust pipe 17 into the inverted U-shape in order to block water. Accordingly, the connection pipe 46 can be made shorter, thus allowing the connection pipe 46 to be disposed in a smaller space.

Figure 8A:
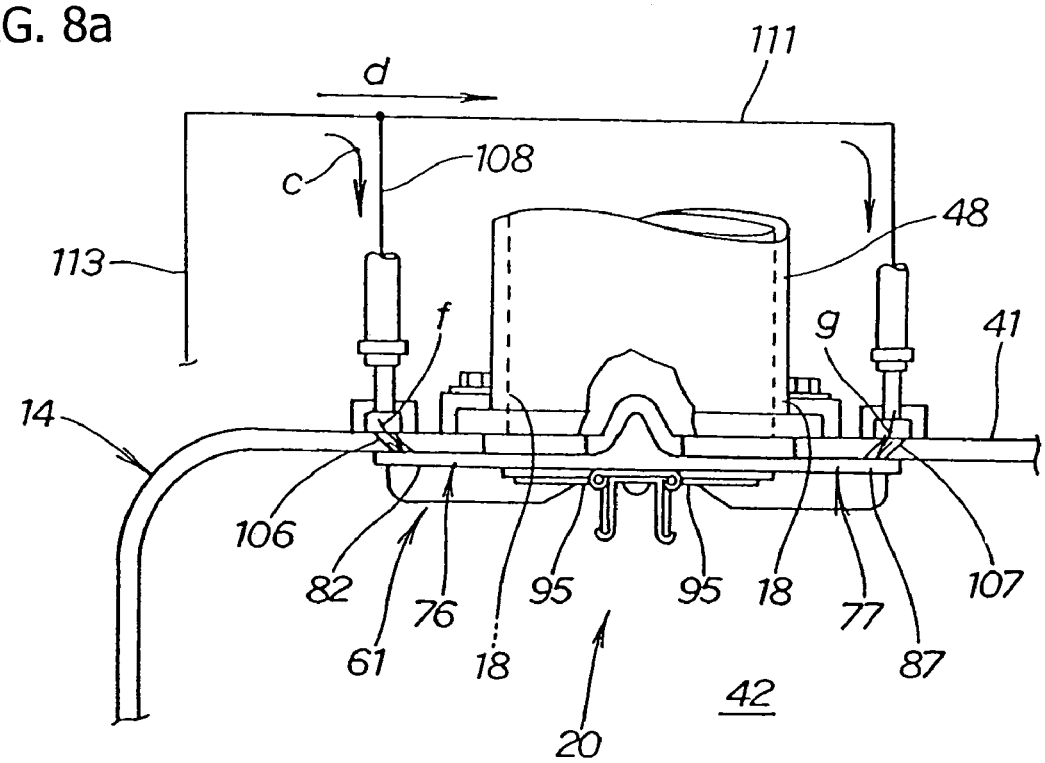
FIG. 8(*a*) is a side view of the exhaust gate valve apparatus of the personal watercraft of FIG. 1, illustrating an exemplary case in which diverted water is directed through the left and right guide flow paths so as to permit the valve body of the exhaust gate valve apparatus to open.
Figure 8B:
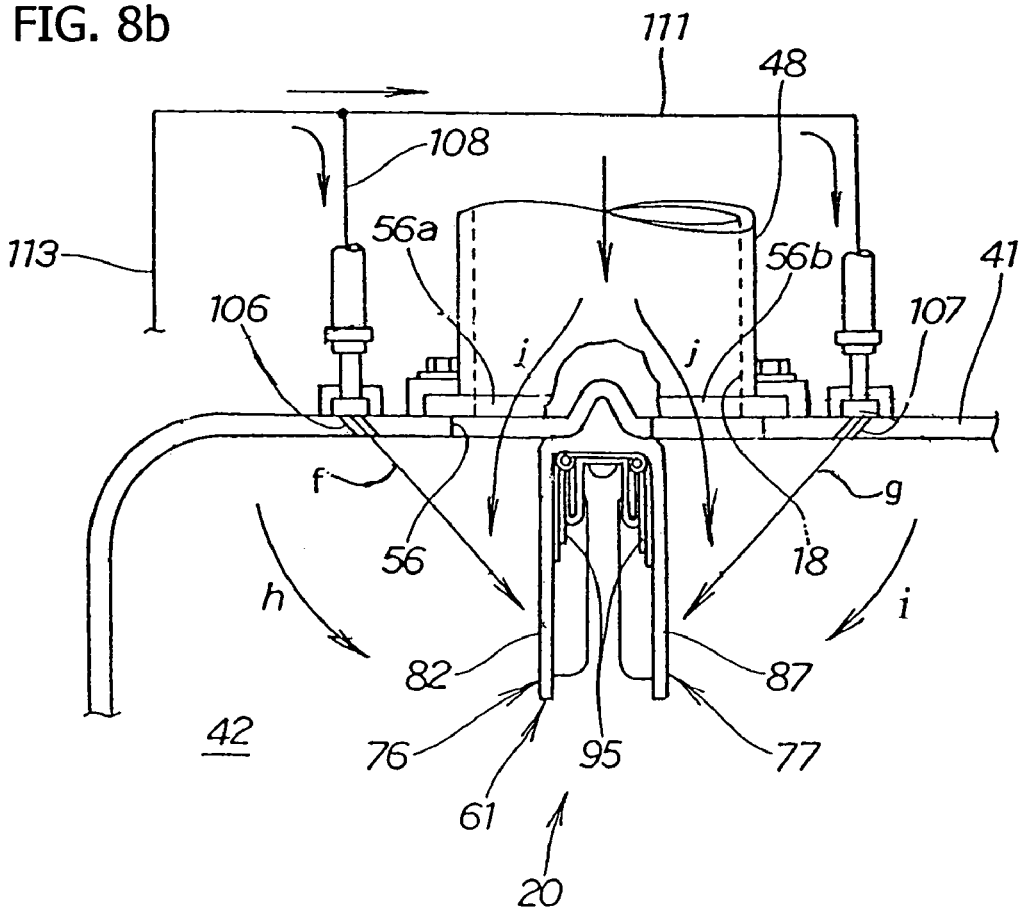

An exemplary case, in which the exhaust port 18 is opened in the exhaust gate valve apparatus 20 of the water jet propulsion-driven watercraft according to the illustrative embodiment of the present invention, will be next described with reference mainly to FIGS. 1, and 8A and 8B. When the engine 13 in the water jet propulsion-driven watercraft 10 shown in FIG. 1 runs, the impeller 32 of the water jet pump 15 is rotated. When the impeller 32 is rotated, jet water is produced rearwardly of the impeller 32. Part of the jet water produced is diverted to the diverter flow path 113 via the diverter port (not shown) and the end portion 113*a* of the diverter flow path 113 (see FIG. 2).

FIGS. 8(*a*) and 8(*b*) are views for illustrating an exemplary case, in which the valve body of the exhaust gate valve apparatus according to the water jet propulsion-driven watercraft according to the illustrative embodiment of the present invention is opened. The diverted jet water to the diverter flow path 113 shown in FIG. 8(*a*) is introduced to the left guide flow path 108 as shown by an arrow c in FIG. 8(*a*) and to the right guide flow path 111 as shown by an arrow d in FIG. 8(*a*). The jet water introduced to the left guide flow path 108 and the right guide flow path 111 is further guided to the left expelling hole 106 and the right expelling hole 107, respectively.

The jet water guided to the left expelling hole 106 is expelled from the left expelling hole 106 as shown by an arrow f in FIG. 8(*a*) and aimed at the left protruding tab 82 of the left flap 76. Similarly, the jet water guided to the right expelling hole 107 is expelled from the right expelling hole 107 as shown by an arrow g in FIG. 8(*a*) and aimed at the right protruding tab 87 of the right flap 77.

Referring to FIG. 8(*b*), permitting the jet water to hit against the left protruding tab 82 applies an expelling force of the jet water to the left protruding tab 82. The expelling force of the jet water is sufficiently larger than the pressing force of the left torsion springs 95, 95. Accordingly, the jet water counteracts the pressing force of the left torsion springs 95, 95, causing the left flap 76 to open widely in the direction of an arrow h shown in FIG. 8(*b*).

Similarly, permitting the jet water to hit against the right protruding tab 87 applies an expelling force of the jet water to the right protruding tab 87. The expelling force of the jet water is sufficiently larger than the pressing force of the right torsion springs 95, 95. Accordingly, the jet water counteracts the pressing force of the right torsion springs 95, 95, causing the right flap 77 to open widely in the direction of an arrow i shown in FIG. 8(*b*).

Widely opening the right and left flaps 76, 77 with the jet water as described above allows the valve body 61 to be opened sufficiently widely. By opening the valve body 61, the exhaust gas is discharged through the exhaust port 18 by way of the opening portion 56 to the space 42 in the pump chamber 14 as shown by an arrow j shown in FIG. 8(*b*). At this time, widely opening the valve body 61 allows the exhaust gas to be preferably discharged as shown by the arrow j in FIG. 8(*b*) without being affected by the valve body 61.

Figure 9A:
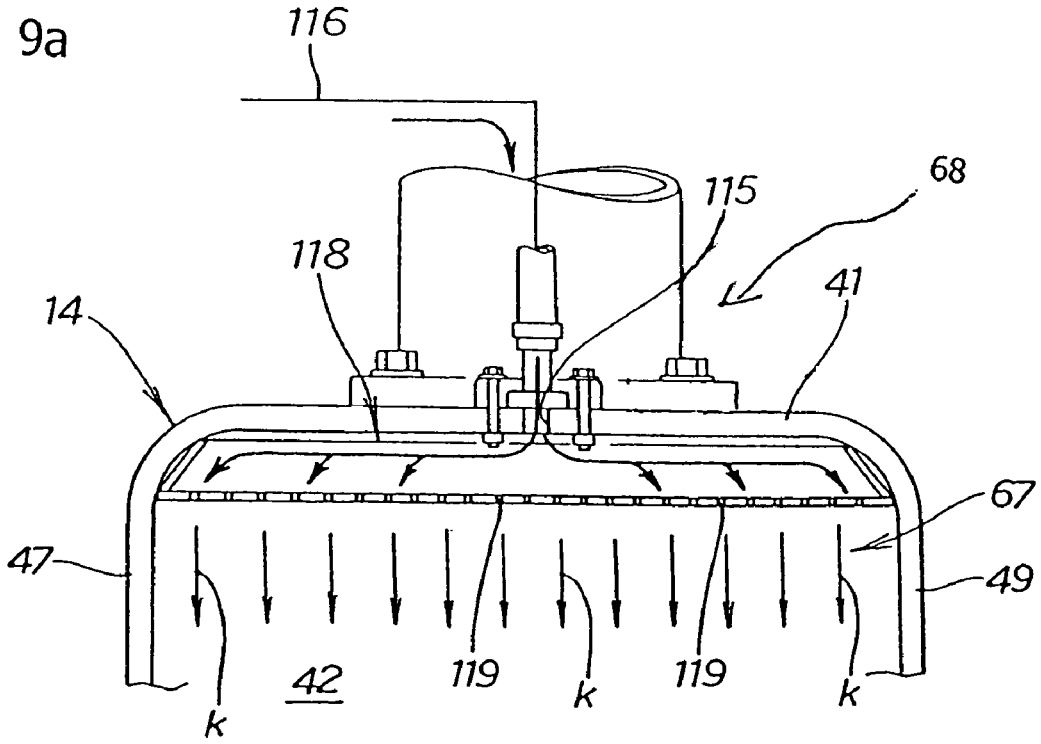
FIG. 9(*a*) is a side view of the exhaust gate valve apparatus of the personal watercraft of FIG. 1, illustrating an exemplary case in which the exhaust noise is shut off by noise insulation means of a water curtain formed within the pump chamber.
Figure 9B:
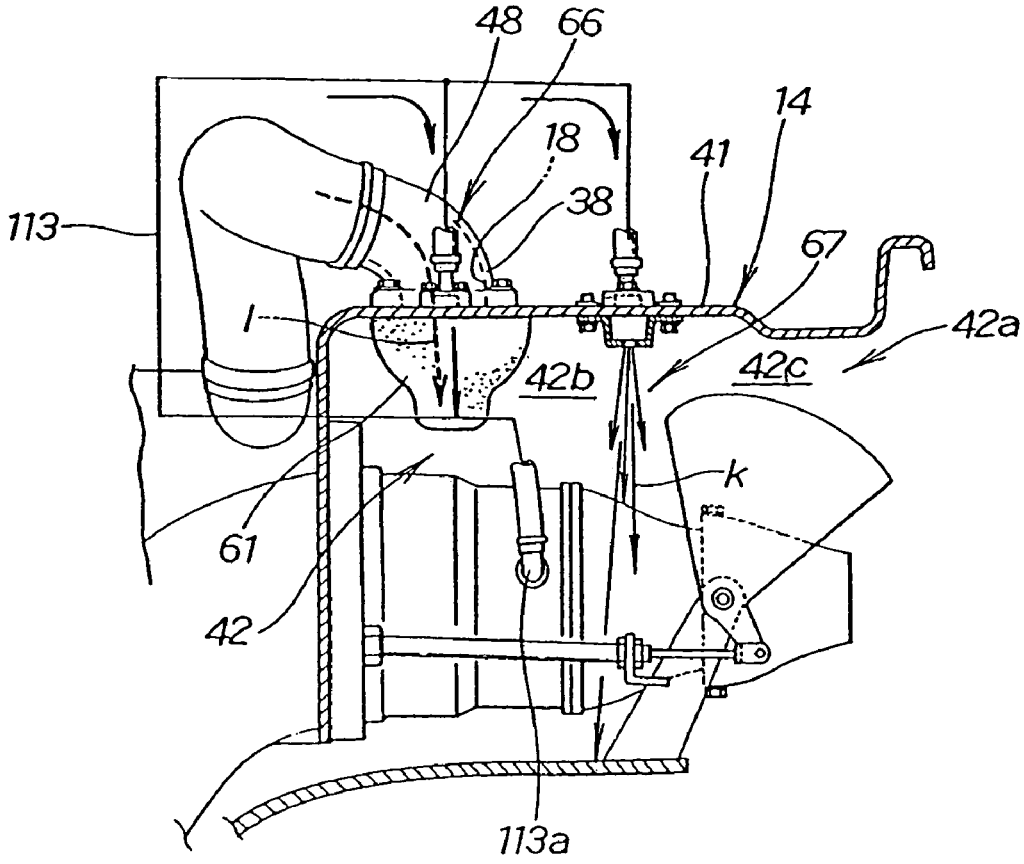
Figure 10:
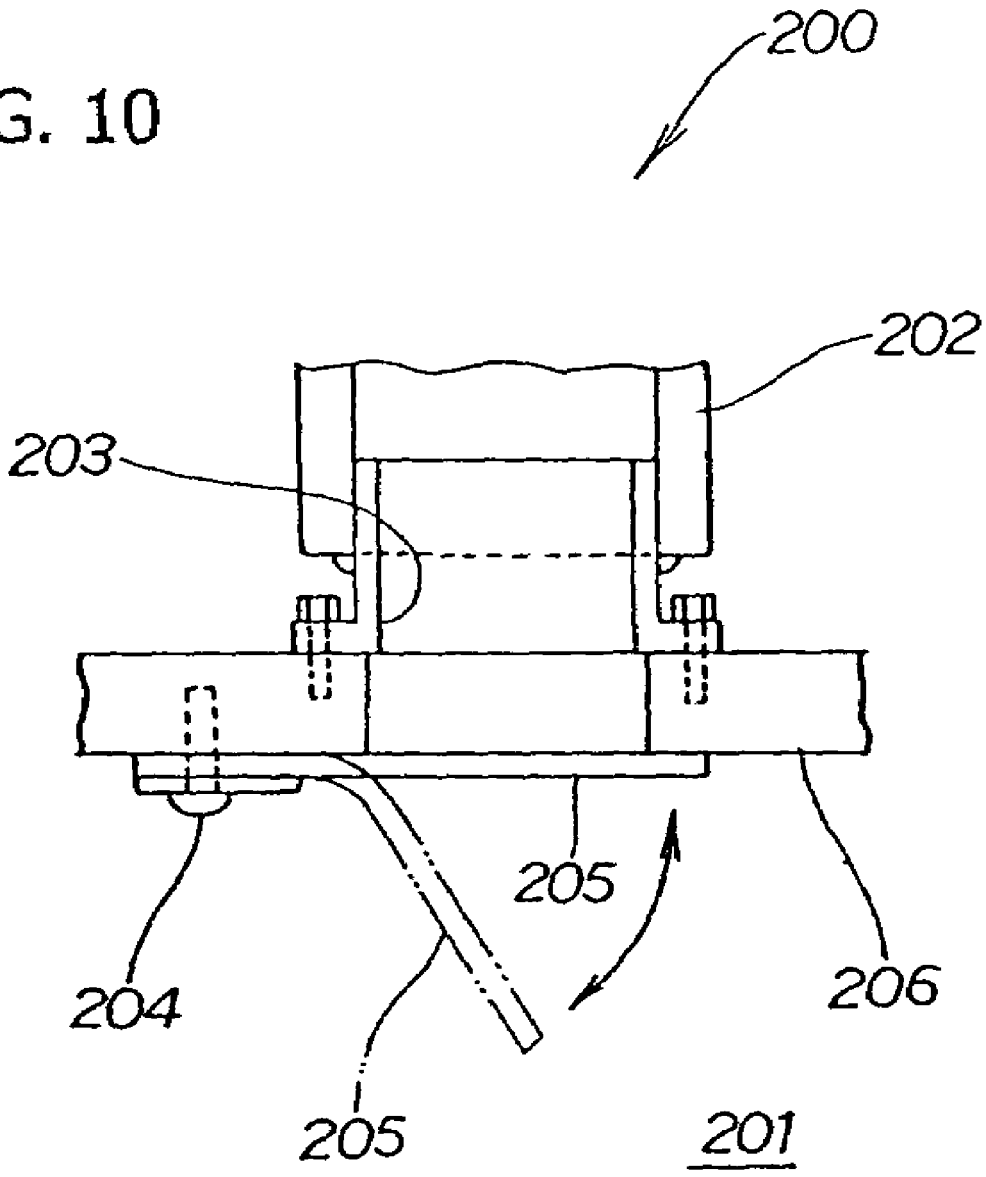
FIG. 10 is a side view of a prior art exhaust gate valve.

An exemplary case, in which an exhaust noise is shut off in the exhaust gate valve apparatus 20 of the water jet propulsion-driven watercraft according to the illustrative embodiment of the present invention, will be described with reference mainly to FIGS. 1, and 9A and 9B. When the engine 13 in the water jet propulsion-driven watercraft 10 shown in FIG. 1 runs, the impeller 32 of the water jet pump 15 is rotated. When the impeller 32 is rotated, jet water is produced rearwardly of the impeller 32. Part of the jet water produced is diverted to the diverter flow path 113 via the diverter port (not shown) and the end portion 113*a* of the diverter flow path 113 (see FIG. 2). Part of the diverted jet water is introduced to the rear guide flow path 116 from the diverter flow path 113.

FIGS. 9(*a*) and 9(*b*) are views for illustrating an exemplary case, in which the exhaust noise is shut off by the noise insulator 68 of the exhaust gate valve apparatus in the water jet propulsion-driven watercraft according to the illustrative embodiment of the present invention.

Referring to FIG. 9(*a*), the jet water introduced to the rear guide flow path 116 is introduced to the dispersion flow path 118 through the introduction hole 115. The jet water introduced to the dispersion flow path 118 is expelled as shown by an arrow k in FIG. 9(*a*) toward the space 42 in the pump chamber 14 from the plurality of expelling holes 119.

The jet water is expelled toward the space 42 in the pump chamber 14 from the plurality of expelling holes 119. The water curtain 67 is thus formed with the jet water expelled as described above. The water curtain 67 is formed throughout an entire area covering from the left wall 47 to the right wall 49 of the pump chamber 14.

Referring to FIG. 9(*b*), the water curtain 67 is disposed between the exhaust port 18 and the open rear end 42*a*. Accordingly, the water curtain 67 partitions off the space 42 in the pump chamber 42 into a space 42*b* located on the side of the exhaust port 18 and a space 42*c* located on the side of the open rear end 42*a*. Now, since the engine 13 of the water jet propulsion-driven watercraft 10 is running, the valve body 61 is opened by the jet water of the jet water expelling device 66.

As the valve body 61 opens, the exhaust gas is discharged from the exhaust port 18 to the space 42*b* as shown by an arrow l (small letter "l" of the alphabet). An exhaust noise is generated at this time. The exhaust noise is, however, substantially muffled by the water curtain 67 and is substantially prevented from leaking to an outside through the open rear end 42*a*. Preventing the exhaust noise from leaking to the outside from the open rear end 42*a* helps reduce the exhaust noise.

It should be noted herein that shapes and configuration of the valve body 61, the valve body support flange 62, the pressure device 64, the a jet water expelling device 66, and the noise insulator 68 exemplified in the illustrative embodiment of the present invention may be arbitrarily modified.

According to the illustrative embodiment of the present invention described heretofore, the water curtain 67 is formed by the noise insulator 68 rearwardly of the exhaust port 18. The present invention is not, however, limited to the aforementioned embodiment. Rather, the same effect can be achieved by, for example, expelling water from a surrounding part of the exhaust port 18, thereby forming a cylinder with the expelled water.

The present invention can be preferably applied to a water jet propulsion-driven watercraft having a hollow pump chamber disposed in a rear portion of a hull, which an exhaust port of an exhaust pipe is made to face.

While a working example of the present invention has been described above, the present invention is not limited to the working example described above, but various design alterations may be carried out without departing from the present invention as set forth in the claims.

What is claimed is:

1. In a water jet propulsion-driven personal watercraft of the type which comprises:

a hull;

a hollow pump chamber disposed at a rear portion of the hull;

a water jet pump disposed in the pump chamber;

an engine disposed in the hull and operatively connected to the water jet pump, the engine serving as a drive power source for the water jet propulsion-driven watercraft; and an exhaust pipe extending from the engine and comprising an exhaust port, the exhaust port of the exhaust pipe being arranged to face the pump chamber;

the improvement comprising an improved exhaust gate valve structure, comprising:

a valve body for opening or closing the exhaust port;

a pressure device for pressing the valve body into a state of closing the exhaust port; and a jet water expelling device, operable to divert part of the jet water from the water jet pump, and to expel the diverted jet water onto the valve body to overcome the force of the pressure device, and thereby force the valve body open.

2. The exhaust gate valve structure for a water jet propulsion-driven watercraft of claim 1, wherein the valve body comprises an elastic plate having an edge portion with an arcuate peripheral shape, the valve body supported along a diameter thereof.

3. The exhaust gate valve structure for a water jet propulsion-driven watercraft of claim 1, wherein the valve body comprises an elastic plate having an edge portion with an arcuate peripheral shape, the valve body supported along a diameter thereof, the valve body comprising a pair of opposed flaps, the opposed flaps moving relative to the supported diameter.

4. The exhaust gate valve structure for a water jet propulsion-driven watercraft of claim 1, wherein the valve body is an elastic plate having a substantially circular peripheral shape, the valve body supported along a diameter thereof by a support flange, the support flange confronting a lower surface of the valve body, the pressure device mounted on the support flange such that the pressure device cooperates with the lower surface of the valve body so as to urge the valve body into a closed position relative to the exhaust port.

5. The exhaust gate valve structure for a water jet propulsion-driven watercraft of claim 1, wherein the valve body is an elastic plate having a substantially circular peripheral shape, the valve body supported along a diameter thereof by a support flange, the valve body supported diameter comprising a hollow protruding portion which extends upwardly from an upper surface thereof along the supported diameter, the exhaust port comprising a port opening formed in a ceiling surface of the pump chamber, the port opening bisected by a rigid support beam extending across the port opening, the rigid support beam comprising a hollow shaped guide portion extending upwardly from an upper surface thereof, the rigid support beam sized and shaped to receive the hollow protruding portion of the valve body therein.

6. The exhaust gate valve structure for a water jet propulsion-driven watercraft of claim 1, wherein the exhaust port comprises a port opening formed in a ceiling surface of the pump chamber, the valve body comprises an elastic plate, the valve body supported along a diameter thereof so as to cover the port opening, the valve body comprising a pair of opposed flaps, the opposed flaps movable relative to the supported diameter, the pressure device urges the flaps against the port opening; and the jet water expelling device expels diverted jet water onto portion of each respective flap adjacent a peripheral edge of the flap so that a pressing force of the pressure device is counteracted and the valve body is thereby opened.

7. The exhaust gate valve structure for a water jet propulsion-driven watercraft of claim 1, wherein a noise insulator for insulating the noise of the engine is provided, the noise insulator comprising a flow dispersion device which receives part of the jet water diverted from the water jet pump and disperses the diverted jet water into a water curtain positioned between the exhaust port and the rear of the watercraft.

8. In a water jet propulsion-driven watercraft, the water jet propulsion-driven watercraft comprising:

a pump chamber disposed at a rear portion of a hull;

a water jet pump disposed in the pump chamber;

an engine connected to the water jet pump, the engine serving as a drive source for the water jet propulsion-driven watercraft; and an exhaust pipe extending from the engine comprising an exhaust port, the exhaust port of the exhaust pipe comprising a port opening formed in a ceiling portion of the pump chamber;

the improvement comprising an exhaust gate valve structure, the exhaust gate valve structure comprising:

a valve body for opening or closing the exhaust port;

the valve body comprising an elastic plate, the valve body supported by a support flange along a diameter of the elastic plate so as to cover the port opening, the support flange fixed to the ceiling portion of the pump chamber adjacent the port opening so as to bisect the port opening, the valve body comprising a pair of opposed flaps, the opposed flaps movable relative to the support flange.

9. The exhaust gate valve structure for a water jet propulsion-driven watercraft of claim 8, the exhaust gate valve structure further comprising:

a pressure device for pressing the valve body into a state of closing the exhaust port.

10. The exhaust gate valve structure for a water jet propulsion-driven watercraft of claim 9, wherein the pressure device comprises at least one resilient member operatively connected to each flap, the resilient member urging the respective flap against the port opening.

11. The exhaust gate valve structure for a water jet propulsion-driven watercraft of claim 9, the exhaust gate valve structure further comprising:

a jet water expelling device for diverting part of the jet water from the water jet pump and expelling the diverted jet water onto each respective flap so that a pressing force of the pressure device is counteracted and the valve body is thereby opened.

12. The exhaust gate valve structure for a water jet propulsion-driven watercraft of claim 8, wherein the support flange confronts a lower surface of the valve body, a pressure device is mounted to the support flange such that the pressure device cooperates with the lower surface of the valve body so as to urge the valve body into a closed position relative to the exhaust port.

13. The exhaust gate valve structure for a water jet propulsion-driven watercraft of claim 8, wherein the valve body supported diameter comprising a hollow protruding portion which extends upwardly from an upper surface thereof along the supported diameter, the port opening of the exhaust port being bisected by a rigid support beam extending across the port opening, the rigid support beam comprising a hollow shaped guide portion extending upwardly from an upper surface thereof, the rigid support beam sized and shaped to receive the hollow protruding portion of the valve body therein permitting accurate positioning of the valve body relative to the port opening.

14. The exhaust gate valve structure for a water jet propulsion-driven watercraft of claim 8, wherein a noise insulator for insulating the noise of the engine is provided, the noise insulator comprising a flow dispersion device which receives jet water diverted from the water jet pump and disperses the diverted jet water into a water curtain positioned between the exhaust port and the rear of the watercraft.

* * * * *